US012031732B2

(12) United States Patent
Minami et al.

(10) Patent No.: US 12,031,732 B2
(45) Date of Patent: Jul. 9, 2024

(54) AIR CONDITIONING SYSTEM, OPERATION CONTROL METHOD THEREFOR, AND OPERATION CONTROL DEVICE FOR AIR CONDITIONING SYSTEM

(71) Applicant: DAIKIN INDUSTRIES, LTD., Osaka (JP)

(72) Inventors: Junya Minami, Osaka (JP); Yasushi Hori, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 18/382,407

(22) Filed: Oct. 20, 2023

(65) Prior Publication Data

US 2024/0044533 A1 Feb. 8, 2024

Related U.S. Application Data

(63) Continuation of application No. PCT/JP2022/006931, filed on Feb. 21, 2022.

(30) Foreign Application Priority Data

Apr. 27, 2021 (JP) ..... 2021-074936

(51) Int. Cl.
*F24F 11/36* (2018.01)
*F24F 11/49* (2018.01)
*F24F 11/89* (2018.01)

(52) U.S. Cl.
CPC ..... *F24F 11/36* (2018.01); *F24F 11/49* (2018.01); *F24F 11/89* (2018.01)

(58) Field of Classification Search
CPC ..... F25B 2500/22; F25B 2500/221; F25B 2500/222; F24F 11/36; F24F 11/49; F24F 11/89
See application file for complete search history.

(56) References Cited

U.S. PATENT DOCUMENTS 11,118,821 B2 * 9/2021 Matsuda ..... F24F 11/36
2009/0107157 A1 * 4/2009 Dube ..... F25B 49/005 62/149

(Continued)

FOREIGN PATENT DOCUMENTS

JP 2000-121211 A 4/2000
JP 2009-180414 A 8/2009

(Continued)

OTHER PUBLICATIONS

International Preliminary Report of corresponding PCT Application No. PCT/JP2022/006931 dated Nov. 9, 2023.

(Continued)

*Primary Examiner* — Nelson J Nieves

(74) *Attorney, Agent, or Firm* — Global IP Counselors, LLP

(57) ABSTRACT

An air conditioning system includes an air conditioning device, a detector, and an alarm. The air conditioning device has a control unit and conditions air in an indoor space. The detector detects the concentration of refrigerant in the indoor space. The alarm notifies of refrigerant leakage in the indoor space. The detector or the alarm transmits information indicating whether or not the detector and the alarm are connected to each other in a wired or wireless manner, to the control unit. The control unit inhibits operation of the air conditioning device when the information indicates that the detector and the alarm are not connected to each other in the wired or wireless manner.

10 Claims, 10 Drawing Sheets

(56) References Cited

U.S. PATENT DOCUMENTS

| | | | | |
|---|---|---|---|---|
| 2016/0109170 | A1* | 4/2016 | Schrey | F25B 49/005 62/126 |
| 2018/0017293 | A1* | 1/2018 | Naito | F25B 13/00 |
| 2019/0195542 | A1* | 6/2019 | Hansen | F24F 1/32 |
| 2021/0018200 | A1* | 1/2021 | Watanabe | F24F 11/62 |
| 2022/0120485 | A1* | 4/2022 | Yamaguchi | F25B 49/005 |
| 2022/0128277 | A1 | 4/2022 | Fukuyama et al. | |
| 2022/0146158 | A1* | 5/2022 | Ohura | F25B 49/005 |
| 2023/0107694 | A1* | 4/2023 | Kawano | F24F 11/755 62/129 |

FOREIGN PATENT DOCUMENTS

| | | | | |
|---|---|---|---|---|
| JP | 2017-36890 | A | 2/2017 | |
| JP | 2017-53571 | A | 3/2017 | |
| JP | 2021-14961 | A | 2/2021 | |
| WO | WO-2021090776 | A1 * | 5/2021 | F24F 11/36 |

OTHER PUBLICATIONS

International Search Report of corresponding PCT Application No. PCT/JP2022/006931 dated Apr. 12, 2022.

* cited by examiner

AIR CONDITIONING SYSTEM, OPERATION CONTROL METHOD THEREFOR, AND OPERATION CONTROL DEVICE FOR AIR CONDITIONING SYSTEM

CROSS-REFERENCE TO RELATED APPLICATIONS

This is a continuation of International Application No. PCT/JP2022/006931 filed on Feb. 21, 2022, which claims priority to Japanese Patent Application No. 2021-074936, filed on Apr. 27, 2021. The entire disclosures of these applications are incorporated by reference herein.

BACKGROUND

Technical Field

The present disclosure relates to an air conditioning system, an operation control method therefor, and an operation control device for the air conditioning system.

Background Art

If mildly flammable refrigerant is used in an air conditioning device, it is mandatory to place a safety device based on the size of a room, the amount of refrigerant which may leak, etc. in order to avoid a risk upon leakage of such refrigerant. The safety device includes a detector (e.g., sensor) that detects the refrigerant leakage and a countermeasure device (e.g., a shut-off valve) as measures against the refrigerant leakage.

In the case of a room with a probability of a regulated amount of refrigerant or more leaking out when the refrigerant leaks, an alarm having an alarming function is installed as a countermeasure device in addition to a detector (see, e.g., Japanese Unexamined Patent Publication No. 2017-36890). The detector and the alarm are respectively connected to an air conditioning device.

SUMMARY

A first aspect of the present disclose is directed to an air conditioning system including an air conditioning device (10), a detector (45), and an alarm (60). The air conditioning device (10) has a control unit (AC), and conditions air in an indoor space (S). The detector (45) detects the concentration of refrigerant in the indoor space (S). The alarm (60) notifies of refrigerant leakage in the indoor space (S). The detector (45) or the alarm (60) transmits the connection state between the detector (45) and the alarm (60) to the control unit (AC). The control unit (AC) inhibits operation of the air conditioning device (10) in a state in which the detector (45) and the alarm (60) are not connected to each other.

DETAILED DESCRIPTION OF EMBODIMENT(S)

Embodiments

Hereinafter, embodiments will be described with reference to the drawings. The embodiments below are merely exemplary ones in nature, and are not intended to limit the scope, application, or use of the invention. Since each of the drawings is intended to illustrate the present disclosure conceptually, dimensions, ratios, or numbers may be exaggerated or simplified as necessary for the sake of ease understanding.

General Configuration of Air Conditioning System

Figure 1:
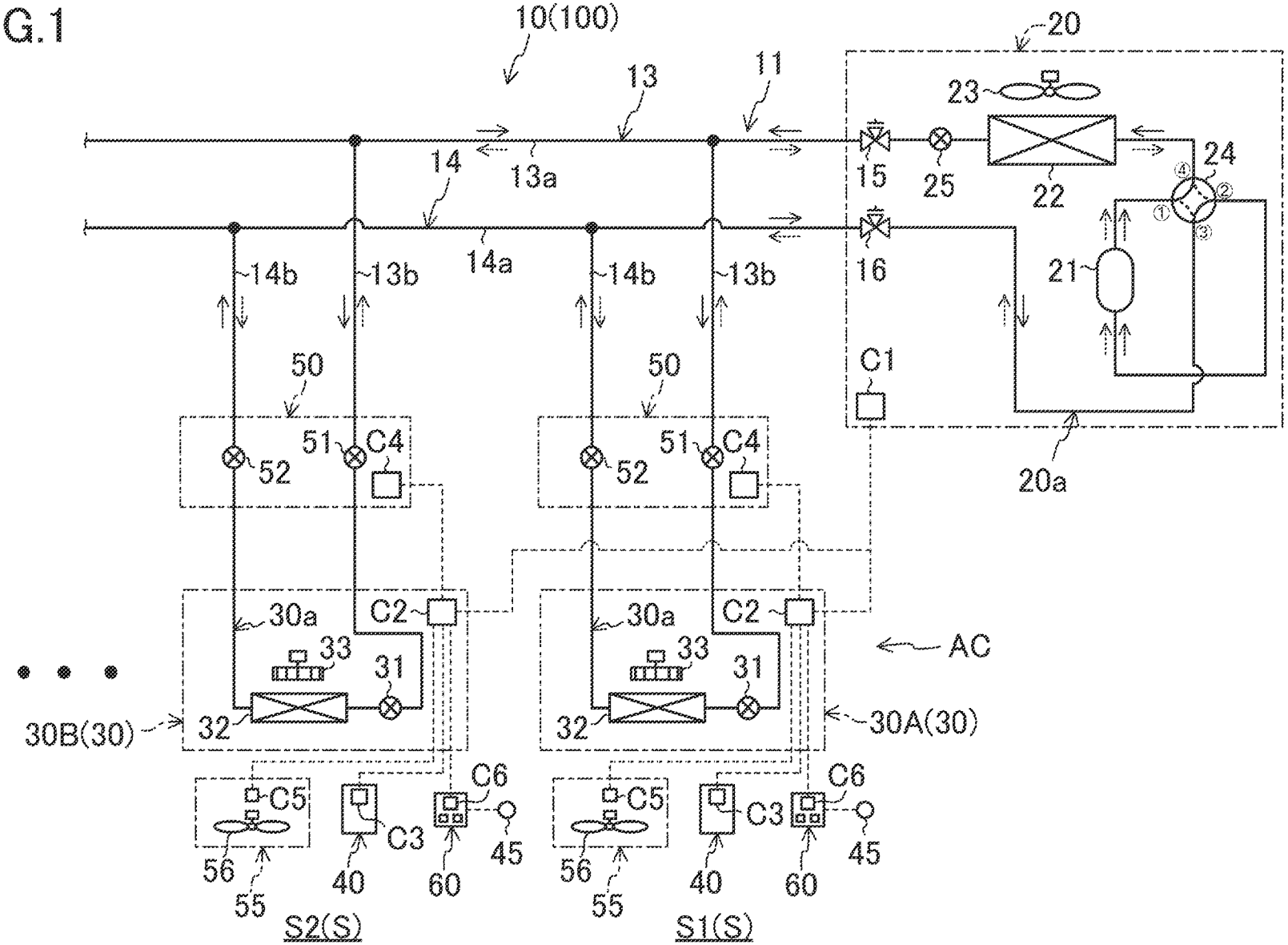
FIG. 1 is a piping system diagram illustrating the configuration of an air conditioning system according to an embodiment.
Figure 2:
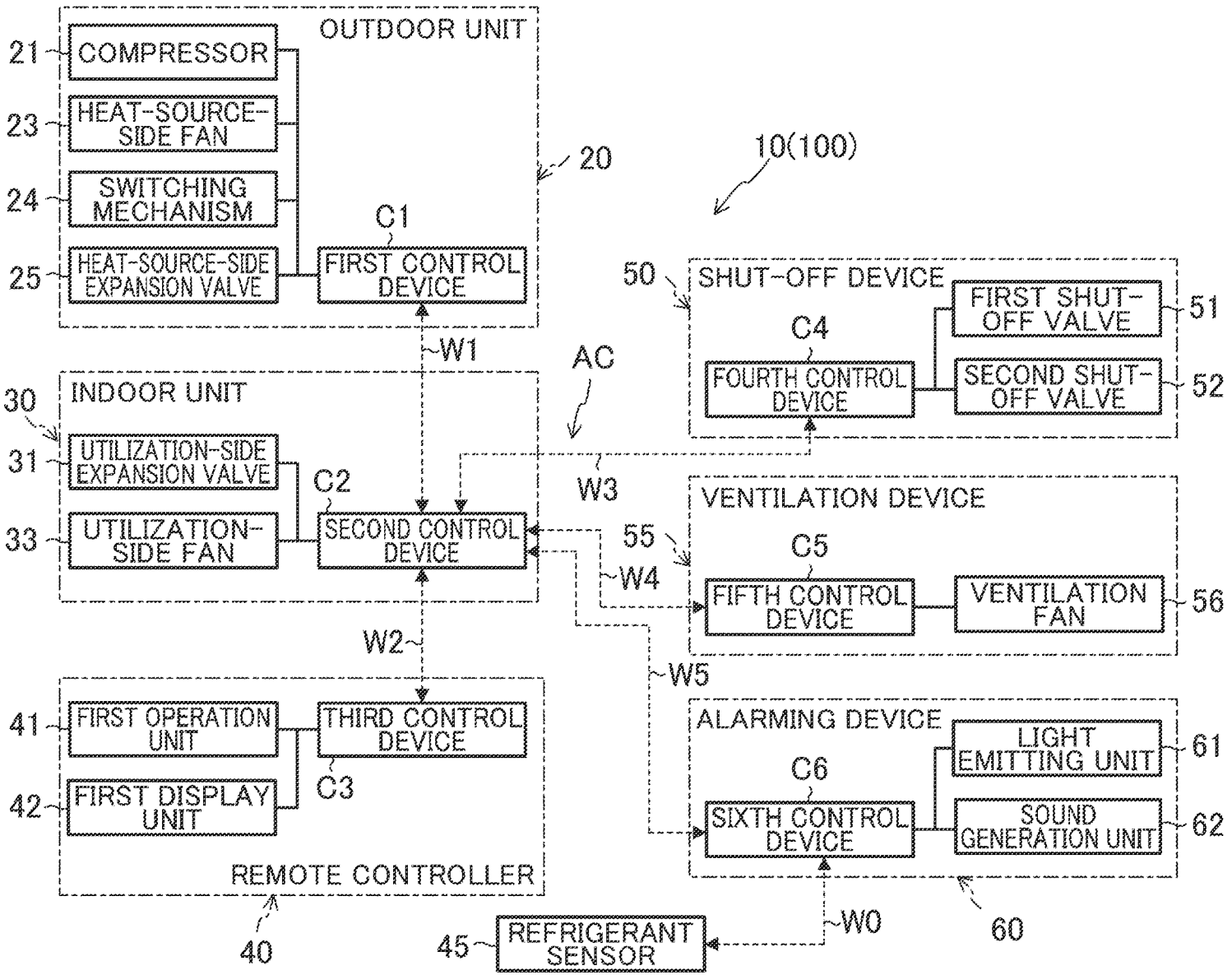
FIG. 2 is a block diagram illustrating a schematic configuration of the air conditioning system illustrated in FIG. 1.

As illustrated in FIGS. 1 and 2, an air conditioning system (100) of this embodiment mainly includes an air conditioning device (10) having a plurality of indoor units (30) and a safety device (45, 50, 55, 60) as countermeasures against refrigerant leakage. The plurality of indoor units (30) includes at least a first indoor unit (30A) and a second indoor unit (30B). The safety device (45, 50, 55, 60) is provided corresponding to an indoor space (S) with the risk of the refrigerant leakage. The safety device (45, 50, 55, 60) includes a detector (45) which is a refrigerant sensor that detects the refrigerant leakage and a countermeasure device for taking measures against the refrigerant leakage based on a detection signal of the detector (45). The countermeasure device includes at least one of a shut-off device (50), a ventilation device (55), and an alarm (60). The alarm (60) functions as an alarming device.

The air conditioning device (10) adjusts the temperature of air in the indoor space (S) to be air-conditioned. The indoor space (S) of this example is an indoor space of, e.g., a building. The air conditioning device (10) performs cooling and heating of the indoor space (S). The air conditioning device (10) is a multi-type air conditioning device having a plurality of indoor units (30) as utilization-side units. The air conditioning device (10) has an outdoor unit (20) as a heat-source-side unit, the plurality of indoor units (30), connection pipes (13, 14), and an air conditioning control unit (AC). The plurality of indoor units (30) and the outdoor unit (20) are connected to each other through the connection pipes (13, 14). Such connection forms a refrigerant circuit (11) as a closed circuit. In this example, the plurality of indoor units (30) includes a first indoor unit (30A) arranged for a first indoor space (51) and a second indoor unit (30B) arranged for a second indoor space (S2).

The refrigerant circuit (11) includes a heat-source-side circuit (20*a*) provided in the outdoor unit (20) and utilization-side circuits (30*a*) each provided in the indoor units (30). The refrigerant circuit (11) is filled with mildly flammable refrigerant. The mildly flammable refrigerant in this example is R32 (difluoromethane). R32 has a relatively low global warming potential (GWP), but is mildly flammable. For this reason, if the refrigerant leaks into the indoor space (S) and a refrigerant concentration in the indoor space (S) becomes high, the refrigerant may be burned. The density of the refrigerant is greater than the density of air. For this reason, when the refrigerant leaks into the indoor space (S), the refrigerant stays in a lower portion in the indoor
space (S).

The connection pipes (13, 14) include a first connection pipe (13) and a second connection pipe (14). The first connection pipe (13) is a liquid connection pipe. The first connection pipe (13) includes a first main pipe (13*a*) and a plurality of first branch pipes (13*b*) branched from the first main pipe (13*a*). One end of the first main pipe (13*a*) is connected to the heat-source-side circuit (20*a*) via a first shut-off valve (15) which is a liquid shut-off valve. One end of each of the plurality of first branch pipes (13*b*) is connected to the first main pipe (13*a*). The other end of each of the plurality of first branch pipes (13*b*) is connected to the corresponding utilization-side circuit (30*a*). The second connection pipe (14) is a gas connection pipe. The second connection pipe (14) includes a second main pipe (14*a*) and a plurality of second branch pipes (14*b*) branched from the second main pipe (14*a*). One end of the second main pipe (14*a*) is connected to the heat-source-side circuit (20*a*) via a second shut-off valve (16) which is a gas shut-off valve. One end of each of the plurality of second branch pipes (14*b*) is connected to the second main pipe (14*a*). The other end of each of the plurality of second branch pipes (14*b*) is connected to the corresponding utilization-side circuit (30*a*).

Outdoor Unit

The outdoor unit (20) is a heat-source-side unit arranged outside. The outdoor unit (20) is arranged, for example, on the roof of a building or on the ground. The outdoor unit (20) has a compressor (21), a heat-source-side heat exchanger (22), and a heat-source-side fan (23). The outdoor unit (20) has a switching mechanism (24) that switches the flow path of refrigerant and a heat-source-side expansion valve (25). The outdoor unit (20) has a first control device (C1) included in the air conditioning control unit (AC).

The compressor (21) compresses sucked refrigerant. The compressor (21) discharges the compressed refrigerant. The compressor (21) is, for example, a rotary compressor of a scroll type, an oscillating piston type, a rolling piston type, or a screw type. The compressor (21) is configured to have a variable operation frequency (number of rotations) by an inverter device.

The heat-source-side heat exchanger (22) is an outdoor heat exchanger. The heat-source-side heat exchanger (22) is a fin-and-tube air heat exchanger. The heat-source-side heat exchanger (22) exchanges heat between refrigerant flowing therein and outdoor air.

The heat-source-side fan (23) is arranged outside in the vicinity of the heat-source-side heat exchanger (22). The heat-source-side fan (23) of this example is a propeller fan. The heat-source-side fan (23) delivers air passing through the heat-source-side heat exchanger (22).

The switching mechanism (24) changes the flow path of the refrigerant circuit (11) so as to switch between a first refrigeration cycle which is a cooling cycle and a second refrigeration cycle which is a heating cycle. The switching mechanism (24) is a four-way switching valve. The switching mechanism (24) has a first port, a second port, a third port, and a fourth port. The first port of the switching mechanism (24) is connected to the discharge portion of the compressor (21). The second port of the switching mechanism (24) is connected to the suction portion of the compressor (21). The third port of the switching mechanism (24) is connected to the second connection pipe (14) via the second shut-off valve (16). The fourth port of the switching mechanism (24) is connected to the gas end of the heat-source-side heat exchanger (22).

The switching mechanism (24) switches between a first state and a second state. The switching mechanism (24) in the first state (state indicated by solid lines in FIG. 1) causes the first port and the fourth port to communicate with each other, and causes the second port and the third port to communicate with each other. The switching mechanism (24) in the second state (state indicated by dashed lines in FIG. 1) causes the first port and the third port to communicate with each other, and causes the second port and the fourth port to communicate with each other.

The heat-source-side expansion valve (25) decompresses refrigerant. The heat-source-side expansion valve (25) is an outdoor expansion valve. The heat-source-side expansion valve (25) is arranged between the first shut-off valve (15) and the heat-source-side heat exchanger (22) in the heat-source-side circuit (20*a*). The heat-source-side expansion valve (25) is an electronic expansion valve whose opening degree is adjustable.

Indoor Unit

The plurality of indoor units (30) of this example include the first indoor unit (30A) and the second indoor unit (30B). The number of indoor units (30) may be three or more. The configurations of the first indoor unit (30A) and the second indoor unit (30B) are basically the same as each other. Hereinafter, for the sake of convenience, each of the first indoor unit (30A) and the second indoor unit (30B) may be simply referred to as an indoor unit (30).

The indoor unit (30) is a utilization-side unit placed in, e.g., a room of a building. The term "room" as used herein includes a space behind a ceiling panel. The indoor unit (30) of this example is of a ceiling mounted type. The term "ceiling mounted type" as used herein includes a ceiling suspended type in which the indoor unit (30) is suspended and a ceiling embedded type in which the indoor unit (30) is arranged in an opening of a ceiling.

The indoor unit (30) has a utilization-side expansion valve (31), a utilization-side heat exchanger (32), and a utilization-side fan (33).

The utilization-side expansion valve (31) decompresses refrigerant. The utilization-side expansion valve (31) is an indoor expansion valve. The utilization-side expansion valve (31) is arranged in the liquid-side flow path of the utilization-side heat exchanger (32) in the utilization-side circuit (30*a*). The utilization-side expansion valve (31) is an electronic expansion valve whose opening degree is adjustable.

The utilization-side heat exchanger (32) is an indoor heat exchanger. The utilization-side heat exchanger (32) is a fin-and-tube air heat exchanger. The utilization-side heat exchanger (32) exchanges heat between refrigerant flowing therein and indoor air.

The utilization-side fan (33) is arranged in the vicinity of the utilization-side heat exchanger (32) in the room. The utilization-side fan (33) of this example is a centrifugal fan. The utilization-side fan (33) delivers air passing through the utilization-side heat exchanger (32).

The indoor unit (30) has a second control device (C2) included in the air conditioning control unit (AC). The second control device (C2) of each indoor unit (30) and the first control device (C1) of the outdoor unit (20) are connected to each other via a first communication line (W1). The first communication line (W1) is wired or wireless.

Remote Controller

The air conditioning device (10) includes a remote controller (40) (hereinafter referred to as a "remote (40)"). One remote (40) of this example is provided for a corresponding one of the indoor units (30). The remote (40) is a device that operates the air conditioning device (10). As illustrated in FIG. 2, the remote (40) includes a first operation unit (41) and a first display unit (42) as functional units. In the present disclosure, the term "functional unit" means a functional unit implemented only by hardware, a functional unit implemented only by software, and a functional unit implemented by a cooperation of hardware and software.

The first operation unit (41) is a functional unit provided for a person to input various instructions to the air conditioning device (10). The first operation unit (41) includes a switch, a button, or a touch panel.

The first display unit (42) is a functional unit that displays the contents of the settings for the air conditioning device (10) and the state of the air conditioning device (10). The first display unit (42) includes a display.

The remote (40) has a third control device (C3) included in the air conditioning control unit (AC). The third control device (C3) and the second control device (C2) of the indoor unit (30) are connected to each other via a second communication line (W2). The second communication line (W2) is wired or wireless.

Safety Device

The air conditioning system (100) illustrated in FIG. 1 has the detector (45) serving as the safety device. The detector (45) is provided corresponding to the indoor space (S) for which it has been determined that the safety device is necessary. In this example, it is assumed that it has been determined that the safety devices for the first indoor space (51) and the second indoor space (S2) are necessary. In this case, the detectors (45) are arranged in the first indoor space (51) and the second indoor space (S2). The detector (45) is, for example, a semiconductor refrigerant sensor. The detector (45) outputs a detection signal having a higher intensity (e.g., current value) as the concentration of leaked refrigerant increases. The detector (45) is not limited to the semiconductor type, and may be of other types such as an infrared type.

The air conditioning system (100) has the shut-off device (50) as the countermeasure device serving as the safety device. The shut-off device (50) is provided corresponding to the indoor space (S) for which it has been determined that the safety device is necessary. In this example, the shut-off devices (50) are provided for the first indoor space (S1) and the second indoor space (S2), i.e., the first indoor unit (30A) and the second indoor unit (30B). The shut-off device (50) has a first shut-off valve (51) and a second shut-off valve (52). The first shut-off valve (51) is a liquid-side shut-off valve. The first shut-off valve (51) of this example is provided in the first branch pipe (13*b*) connected to each indoor unit (30). The first shut-off valve (51) is an on-off valve such as an electromagnetic valve or an electric valve. The second shut-off valve (52) is a gas-side shut-off valve. The second shut-off valve (52) of this example is provided in the second branch pipe (14*b*) connected to each indoor unit (30). The second shut-off valve (52) is an on-off valve such as an electromagnetic valve or an electric valve. The shut-off device (50) has a fourth control device (C4). The fourth control device (C4) and the second control device (C2) of each indoor unit (30) are connected to each other via a third communication line (W3). The third communication line (W3) is wired or wireless.

The air conditioning system (100) has the ventilation device (55) as the countermeasure device serving as the safety device. The ventilation device (55) is provided corresponding to the indoor space (S) for which it has been determined that the safety device is necessary. In this example, the ventilation devices (55) are provided for the first indoor space (S1) and the second indoor space (S2), i.e., the first indoor unit (30A) and the second indoor unit (30B). The ventilation device (55) has a ventilation fan (56). The ventilation fan (56) discharges air in the indoor space (S) to the outside via an exhaust path (not shown). The ventilation device (55) has a fifth control device (C5). The fifth control device (C5) and the second control device (C2) of each indoor unit (30) are connected to each other via a fourth communication line (W4). The fourth communication line (W4) is wired or wireless.

The air conditioning system (100) has the alarm (60) as the countermeasure device serving as the safety device. The alarm (60) is provided corresponding to the indoor space (S) for which it has been determined that the safety device is necessary, and functions as the alarming device. In this example, the alarms (60) are provided for the first indoor space (S1) and the second indoor space (S2), i.e., the first indoor unit (30A) and the second indoor unit (30B). The alarm (60) has a light emitting unit (61) and a sound generation unit (62). The light emitting unit (61) notifies a person of the refrigerant leakage by light. The light emitting unit (61) is, for example, an LED. The sound generation unit (62) notifies a person of the refrigerant leakage by sound. The sound generation unit (62) is, for example, a speaker. The alarm (60) has a sixth control device (C6). The sixth control device (C6) and the second control device (C2) of each indoor unit (30) are connected to each other via a fifth communication line (W5). The fifth communication line (W5) is wired or wireless.

As one feature of this embodiment, the alarm (60) (specifically, the sixth control device (C6)) and the detector (45) are connected to each other via a dedicated communication line (W0). The dedicated communication line (W0) is wired or wireless. The detection signal output from the detector (45) is input to the sixth control device (C6) via the dedicated communication line (W0). Instead of connecting the alarm (60) and the detector (45) via the dedicated communication line (W0), the alarm (60) and the detector (45) may be connected via a cord, chain, or the like. having no communication function. In this case, the detector (45) and the second control device (C2) of each indoor unit (30) are connected to each other via a wired or wireless communication line, and the detection signal output from the detector (45) is input to the second control device (C2) via such a communication line.

Air Conditioning Control Unit

The air conditioning control unit (AC) controls operation of the air conditioning device (10). The air conditioning control unit (AC) includes the first control device (C1), the second control device (C2), the third control device (C3), the first communication line (W1), the second communication line (W2), the third communication line (W3), the fourth communication line (W4), and the fifth communication line (W5). The fourth control device (C4), the fifth control device (C5), and the sixth control device (C6) may also form part of the air conditioning control unit (AC). Each of the first control device (C1), the second control device (C2), the third control device (C3), the fourth control device (C4), the fifth control device (C5), and the sixth control device (C6) includes a micro control unit (MCU), an electric circuit, and an electronic circuit. The MCU includes a central processing unit (CPU), a memory, and a communication interface. The memory stores various programs to be executed by the CPU.

The first control device (C1) is an outdoor unit control unit. The first control device (C1) controls the compressor (21), the heat-source-side expansion valve (25), and the heat-source-side fan (23).

The second control device (C2) is an indoor unit control unit. The second control device (C2) controls the utilization-side expansion valve (31) and the utilization-side fan (33). The detection signal of the detector (45) is input to the second control device (C2) via the sixth control device (C6). The second control device (C2) determines, based on the detection signal of the detector (45), whether or not a first condition indicating the refrigerant leakage is satisfied. When the first condition is satisfied, the second control device (C2) outputs a signal for operating the countermeasure device (50, 55, 60).

The third control device (C3) outputs an instruction based on the input of the first operation unit (41) to the second control device (C2). The third control device (C3) causes the first display unit (42) to display predetermined information in response to the input of the first operation unit (41).

The fourth control device (C4) controls the open/close state of the first shut-off valve (51) and the second shut-off valve (52). When the signal output from the second control device (C2) is input to the fourth control device (C4), the fourth control device (C4) closes the first shut-off valve (51) and the second shut-off valve (52).

The fifth control device (C5) controls the ventilation fan (56). When the signal output from the second control device (C2) is input to the fifth control device (C5), the fifth control device (C5) operates the ventilation fan (56).

The sixth control device (C6) controls the light emitting unit (61) and the sound generation unit (62). When the signal output from the second control device (C2) is input to the sixth control device (C6), the sixth control device (C6) operates the light emitting unit (61) and the sound generation unit (62).

Instead of the second control device (C2) determining the refrigerant leakage, the sixth control device (C6) may determine, based on the detection signal of the detector (45), whether or not the first condition indicating the refrigerant leakage is satisfied, and operate the light emitting unit (61) and the sound generation unit (62) when the first condition is satisfied. When the first condition is satisfied, the sixth control device (C6) may output refrigerant leakage occurrence information to the second control device (C2). When the refrigerant leakage occurrence information is output from the sixth control device (C6) to the second control device (C2), the second control device (C2) outputs a signal for operating the other countermeasure devices (50, 55), i.e., the shut-off device (50) and the ventilation device (55).

Centralized Monitoring Device

Figure 3:
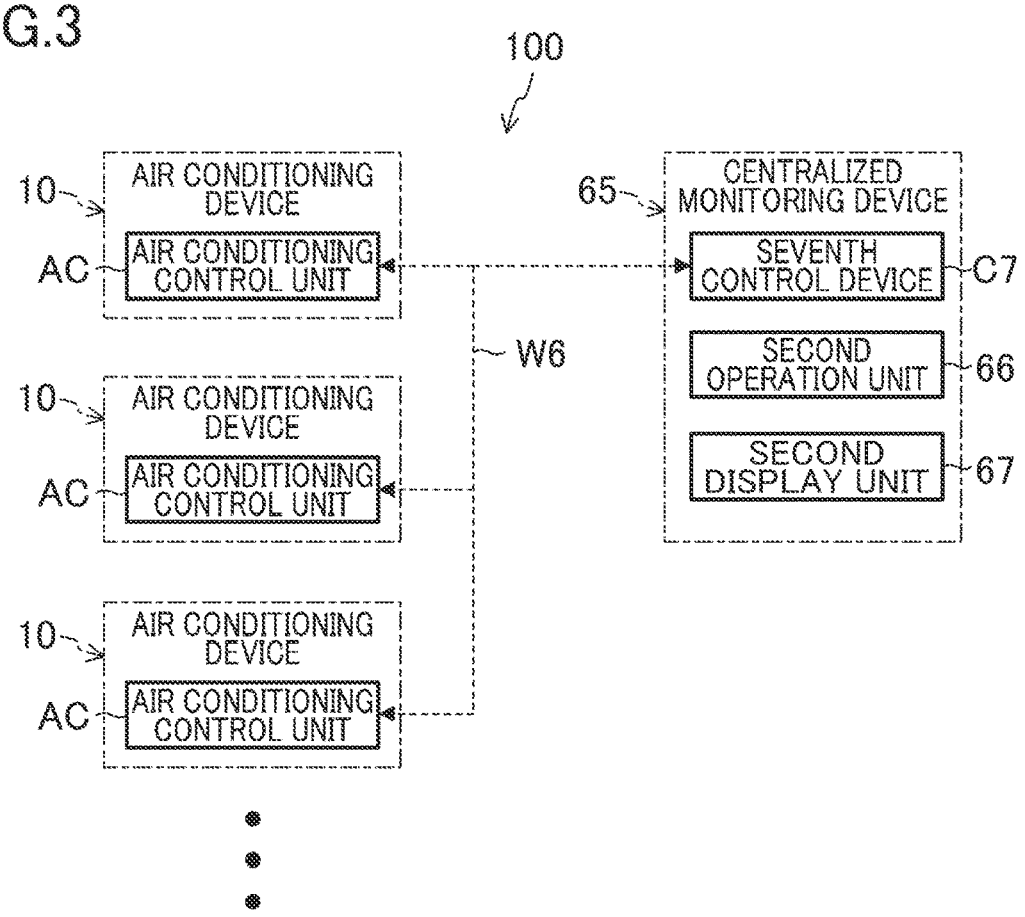
FIG. 3 is a block diagram illustrating a schematic configuration of an air conditioning system according to a variation.

The air conditioning device (10) is a single-system device having one refrigerant circuit (11). In, e.g., a building, an air conditioning system (1) including plural systems of air conditioning devices (10) is built. In this case, as illustrated in FIG. 3, the air conditioning system (100) may have a plurality of air conditioning devices (10) and a centralized monitoring device (65). The centralized monitoring device (65) has a second operation unit (66) and a second display unit (67) as functional units. The second operation unit (66) is a functional unit provided for a person (e.g., administrator) to input various instructions to each air conditioning device (10). The second operation unit (66) includes a switch, a button, or a touch panel. The second display unit (67) is a functional unit that displays the contents of the settings for each air conditioning device (10) and the state of each air conditioning device (10). The second display unit (67) includes a display. The centralized monitoring device (65) has a seventh control device (C7). The seventh control device (C7) and the air conditioning control unit (AC) of each air conditioning device (10) are connected to each other via a sixth communication line (W6). The sixth communication line (W6) is wired or wireless. The seventh control device (C7) includes an MCU, an electric circuit and an electronic circuit. The MCU includes a CPU, a memory, and a communication interface. The memory stores various programs to be executed by the CPU.

Operation of Air Conditioning Device

Operation of the air conditioning device (10) will be described with reference to FIG. 1. The air conditioning device (10) switchably performs the cooling operation and the heating operation. In FIG. 1, the flow of refrigerant in the cooling operation is indicated by solid arrows, and the flow of refrigerant in the heating operation is indicated by dashed arrows.

In the cooling operation, the first control device (C1) operates the compressor (21) and the heat-source-side fan (23), brings the switching mechanism (24) into the first state, and fully opens the heat-source-side expansion valve (25). The second control device (C2) operates the utilization-side fan (33), and adjusts the utilization-side expansion valve (31) to a predetermined opening degree. In the normal cooling operation, the first shut-off valve (51) and the second shut-off valve (52) are in the open state.

In the cooling operation, the refrigerant circuit (11) performs the first refrigeration cycle. In the first refrigeration cycle, the heat-source-side heat exchanger (22) functions as a radiator (precisely, a condenser), and the utilization-side heat exchanger (32) functions as an evaporator. Specifically, refrigerant compressed by the compressor (21) flows through the heat-source-side heat exchanger (22). In the heat-source-side heat exchanger (22), the refrigerant dissipates heat to the outdoor air to condense. The refrigerant condensed in the heat-source-side heat exchanger (22) flows through the first connection pipe (13), and is branched into each utilization-side circuit (30*a*). In each utilization-side circuit (30*a*), the refrigerant is decompressed by the utilization-side expansion valve (31), and then, flows through the utilization-side heat exchanger (32). In the utilization-side heat exchanger (32), the refrigerant absorbs heat from the indoor air to evaporate. The refrigerant evaporated in each utilization-side heat exchanger (32) join together in the second connection pipe (14), and then, is sucked into the compressor (21).

In the heating operation, the first control device (C1) operates the compressor (21) and the heat-source-side fan (23), brings the switching mechanism (24) into the second state, and adjusts the heat-source-side expansion valve (25) to a predetermined opening degree. The second control device (C2) operates the utilization-side fan (33), and adjusts the utilization-side expansion valve (31) to a predetermined opening degree. In the normal heating operation, the first shut-off valve (51) and the second shut-off valve (52) are in the open state.

In the heating operation, the refrigerant circuit (11) performs the second refrigeration cycle. In the second refrigeration cycle, the utilization-side heat exchanger (32) functions as a radiator (precisely, a condenser), and the heat-source-side heat exchanger (22) functions as an evaporator. Specifically, refrigerant compressed by the compressor (21) flows through the second connection pipe (14), and is branched into each utilization-side circuit (30*a*). In each utilization-side circuit (30*a*), the refrigerant flows through the utilization-side heat exchanger (32). In the utilization-side heat exchanger (32), the refrigerant dissipates heat to the indoor air to condense. The refrigerant condensed in each utilization-side heat exchanger (32) is decompressed by a corresponding one of the utilization-side expansion valves (31), and then, join together in the first connection pipe (13). The refrigerant in the first connection pipe (13) is decompressed by the heat-source-side expansion valve (25), and then, flows through the heat-source-side heat exchanger (22). In the heat-source-side heat exchanger (22), the refrigerant absorbs heat from the outdoor air to evaporate. The refrigerant evaporated in the heat-source-side heat exchanger (22) is sucked into the compressor (21).

Operation upon Refrigerant Leakage

Figure 4:
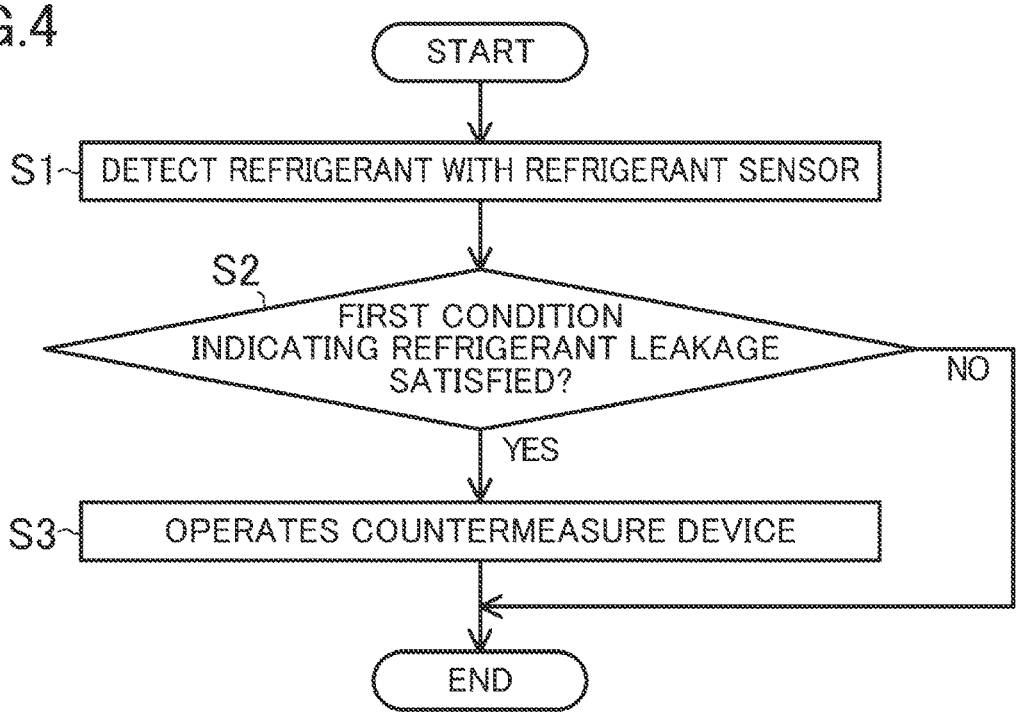
FIG. 4 is a flowchart illustrating operation of a safety device of the air conditioning system according to the embodiment or the variation.

Operation of the air conditioning system (100) upon the refrigerant leakage will be described with reference to FIG. 4. When refrigerant leaks from the indoor unit (30), the leaked refrigerant flows into the indoor space (S). Specifically, since the density of refrigerant is greater than the density of air, the refrigerant flows downward in the indoor space (S). As a result, the concentration of the refrigerant in the indoor space (S) gradually increases.

In Step S1, the detector (45) which is the refrigerant sensor detects the refrigerant leakage. The detection value of the detector (45) is input to the second control device (C2) of the indoor unit (30) via the dedicated communication line (W0), the sixth control device (C6), and the fifth communication line (W5).

In Step S2, the second control device (C2) determines, based on the detection signal of the detector (45), whether or not the first condition indicating the refrigerant leakage is satisfied. The first condition is whether or not the detection value (e.g., current value) of the detector (45) is a predetermined value or more. When the first condition is satisfied, the second control device (C2) outputs a signal for operating the countermeasure device (50, 55, 60).

When the signal output from the second control device (C2) is input to the countermeasure device (50, 55, 60), the countermeasure device (50, 55, 60) is operated in Step S3. Specifically, in Step S3, when the signal output from the second control device (C2) is input to the fourth control device (C4), the fourth control device (C4) closes the first and second shut-off valves (51), (52) of the shut-off device (50). In Step S3, when the signal output from the second control device (C2) is input to the fifth control device (C5), the fifth control device (C5) operates the ventilation fan (56). In Step S3, when the signal output from the second control device (C2) is input to the sixth control device (C6), the sixth control device (C6) operates the light emitting unit (61) and the sound generation unit (62). More specifically, the sixth control device (C6) causes the light emitting unit (61) to emit light. In addition, the sixth control device (C6) causes the sound generation unit (62) to generate sound such as warning sound.

Through the above-described operation, leakage of the refrigerant in the refrigerant circuit (11) of the air conditioning device (10) of one system into the first indoor space (S1) can be reduced.

When the sixth control device (C6) makes, instead of the second control device (C2), determination on refrigerant leakage, the flow thereof is as follows. First, when the detection value of the detector (45) is input to the sixth control device (C6) of the alarm (60) via the dedicated communication line (W0) in Step S1, the sixth control device (C6) determines, based on the detection signal of the detector (45), whether or not the first condition indicating the refrigerant leakage is satisfied in Step S2. When the first condition is satisfied, the sixth control device (C6) operates the light emitting unit (61) and the sound generation unit (62), and outputs the refrigerant leakage occurrence information to the second control device (C2) in Step S3. The second control device (C2) having received the refrigerant leakage occurrence information outputs a signal for operating the shut-off device (50) and the ventilation device (55).

Variation 1 of Air Conditioning System

Figure 5:
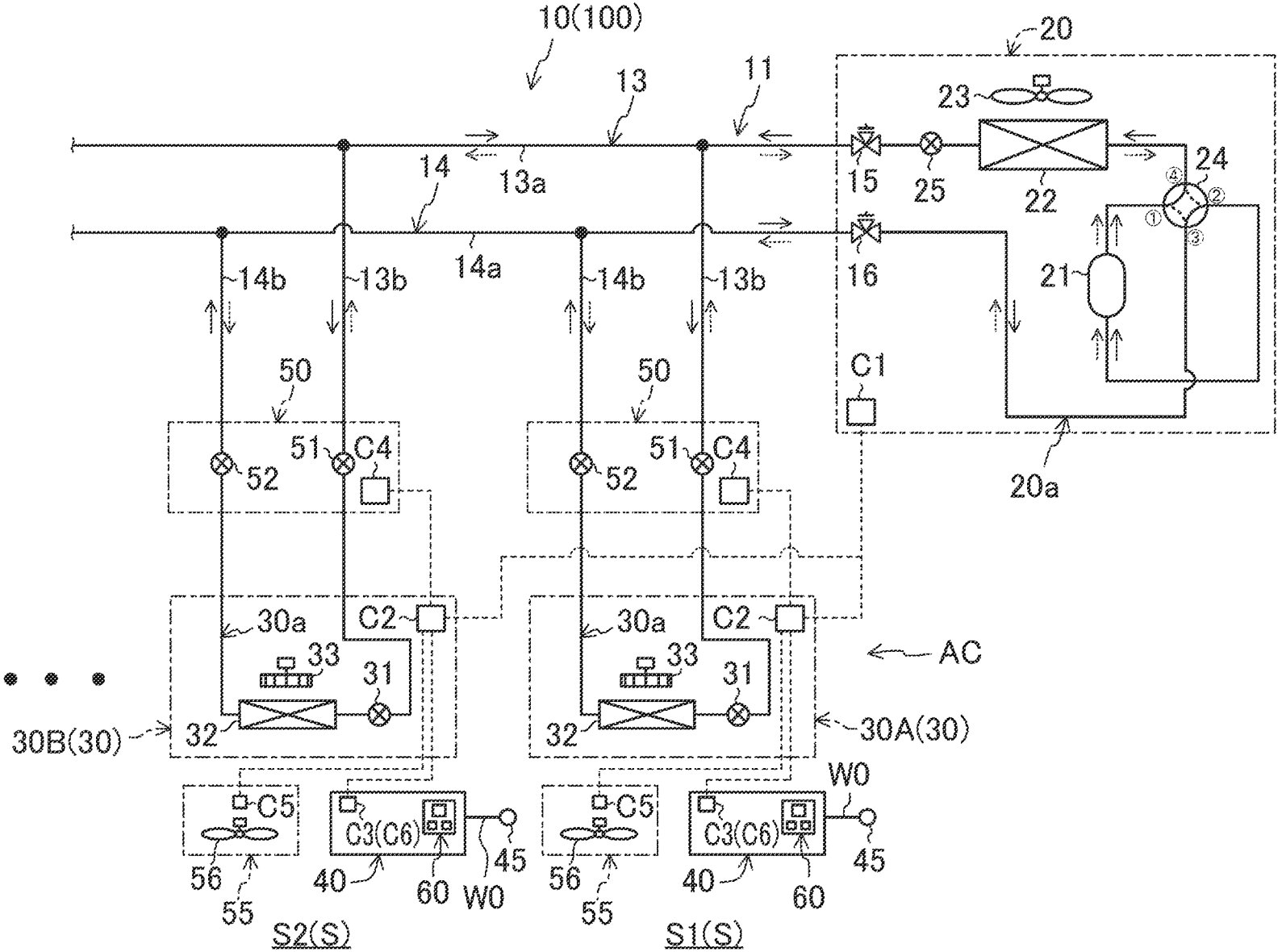
FIG. 5 is a piping system diagram illustrating the configuration of the air conditioning system according to the variation.

In the air conditioning system (100) illustrated in FIG. 1, the remote (40) and the alarm (60) are separately arranged in the indoor space (S). Instead, as illustrated in FIG. 5, the alarm (60) may be built in the remote (40). In this case, the function of the sixth control device (C6) of the alarm (60) may be incorporated into the third control device (C3) of the remote (40), or the sixth control device (C6) and the third control device (C3) may be arranged as independent control devices in the remote (40).

In the air conditioning system (100) illustrated in FIG. 5, the remote (40) (specifically, the third control device (C3) or the sixth control device (C6)) and the detector (45) are connected to each other via the dedicated communication line (W0). The dedicated communication line (W0) is wired or wireless. The detection signal output from the detector (45) is input to the third control device (C3) or the sixth control device (C6) via the dedicated communication line (W0).

Variation 2 of Air Conditioning System

Figure 6:
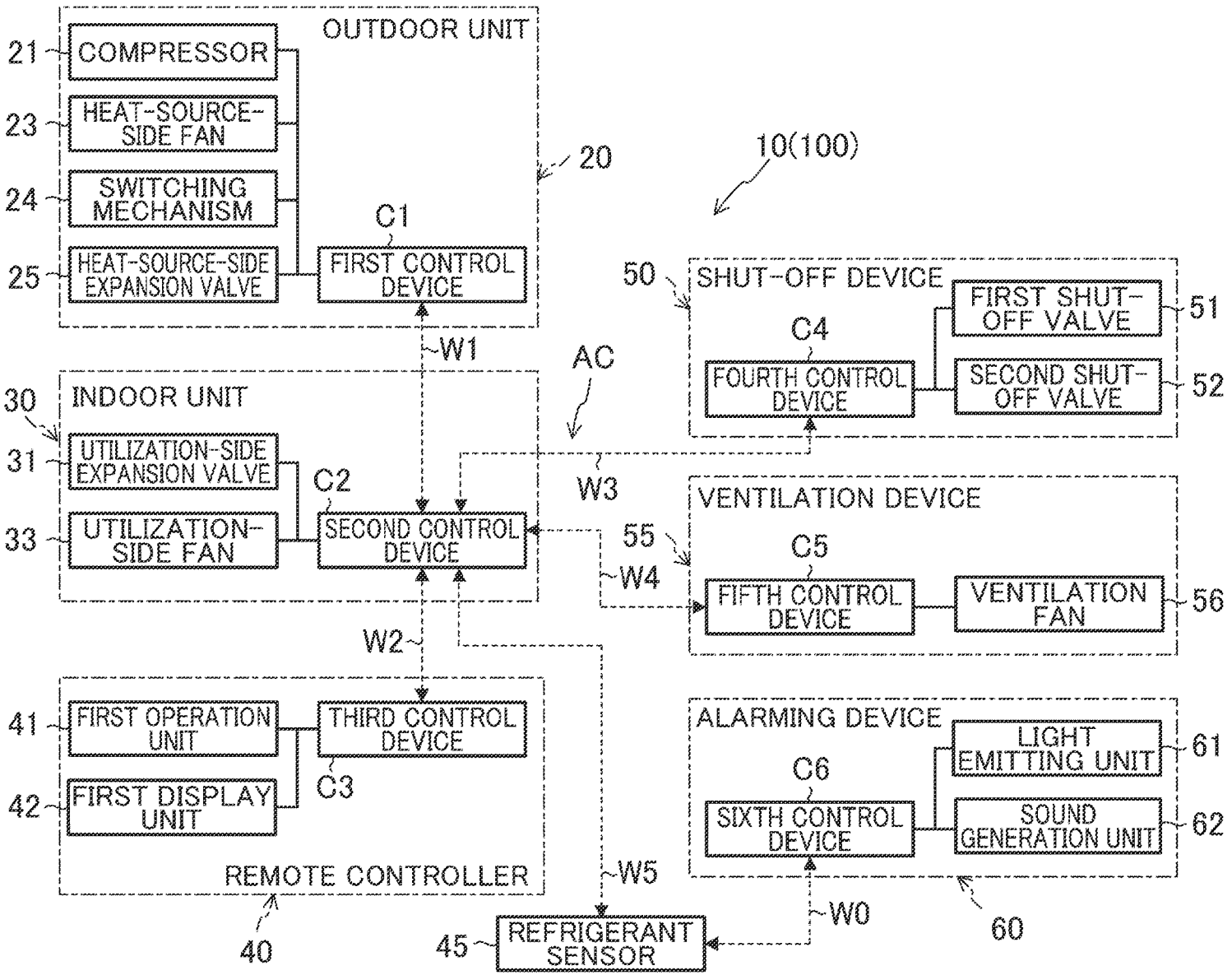
FIG. 6 is a block diagram illustrating a schematic configuration of the air conditioning system according to the variation.

In the air conditioning system (100) illustrated in FIG. 2, the sixth control device (C6) of the alarm (60) is connected to the detector (45) via the dedicated communication line (W0), and the sixth control device (C6) is connected to the second control device (C2) of each indoor unit (30) via the fifth communication line (W5). Instead, the detector (45) may be connected to the second control device (C2) of each indoor unit (30) via the fifth communication line (W5) as illustrated in FIG. 6 with the sixth control device (C6) and the detector (45) connected to each other via the dedicated communication line (W0).

In the air conditioning system (100) illustrated in FIG. 2, the second control device (C2) of each indoor unit (30) and the detector (45) transmit and receive signals etc. via the alarm (60) (specifically, the sixth control device (C6)). On the other hand, in the air conditioning system (100) illustrated in FIG. 6, the second control device (C2) of each indoor unit (30) and the alarm (60) transmit and receive signals etc. via the detector (45).

Operation Control Method for Air Conditioning System

In the air conditioning system (100) of this embodiment (including the above-described variations, the same also applies hereinafter), the detector (45) or the alarm (60) in each indoor space (S) transmits the connection state between the detector (45) and the alarm (60) to the air conditioning control unit (AC) (e.g., the second control device (C2) of the indoor unit (30)). Based on such transmitted information, the air conditioning control unit (AC) (e.g., the first control device (C1) of the outdoor unit (20)) inhibits operation of the air conditioning device (10) when the detector (45) and the alarm (60) are not connected to each other. That is, in the air conditioning system (100), an interlock release condition is that the detector (45) and the alarm (60) are connected to each other.

As illustrated in FIG. 5, in a case where the alarm (60) is built in the remote (40), the air conditioning control unit (AC) inhibits operation of the air conditioning device (10) in a state in which the remote (40) and the detector (45) are not wire-connected to each other. That is, in the air conditioning system (100) illustrated in FIG. 5, the interlock release condition is that the remote (40) including the alarm (60) is connected to the detector (45).

One example of the operation control method for the air conditioning system (100) for which the above-described interlock is set will be described with reference to FIG. 7. In the following description, it is assumed that the detector (45) or the alarm (60) is connected to the air conditioning device (10), specifically the second control device (C2) of the indoor unit (30).

First, in Step S11, the air conditioning control unit (AC) receives the connection state between the detector (45) and the alarm (60) (in a case of the alarm (60) including the remote (40), the remote (40), the same also applies hereinafter) in each indoor space (S) from the detector (45) or the alarm (60). The connection between the detector (45) and the alarm (60) includes not only connection via the wired or wireless dedicated communication line (W0), but also connection via a cord, chain or the like having no communication function. In addition, the state in which the detector (45) and the alarm (60) are connected to each other may include a case where the detector (45) and the alarm (60) are integrally configured as, e.g., a detection alarm.

Next, in Step S12, the air conditioning control unit (AC) determines, based on the information received in Step S11, whether or not the detector (45) and the alarm (60) are connected to each other.

When the connection between the detector (45) and the alarm (60) is confirmed in Step S12, the air conditioning control unit (AC) permits operation of the air conditioning device (10) in Step S13.

On the other hand, when no connection between the detector (45) and the alarm (60) is confirmed in Step S12, the air conditioning control unit (AC) inhibits operation of the air conditioning device (10) in Step S14.

As described above, in the operation control method for the air conditioning system (100) in this embodiment, the air conditioning control unit (AC) basically inhibits operation of the air conditioning device (10) when both the detector (45) and the alarm (60) are not connected to the air conditioning device (10). However, when the detector (45) or the alarm (60) is connected to the air conditioning device (10) and information indicating that the detector (45) and the alarm (60) are connected to each other is received from the detector (45) or the alarm (60), the air conditioning control unit (AC) permits operation of the air conditioning device (10). In other words, even if both the detector (45) and the alarm (60) are not directly connected to the air conditioning device (10), the air conditioning control unit (AC) permits operation of the air conditioning device (10) as long as one of the detector (45) or the alarm (60) is directly connected to the air conditioning device (10) and the other of the detector (45) or the alarm (60) is indirectly connected to the air conditioning device (10) via the one of the detector (45) or the alarm (60).

Figure 7:
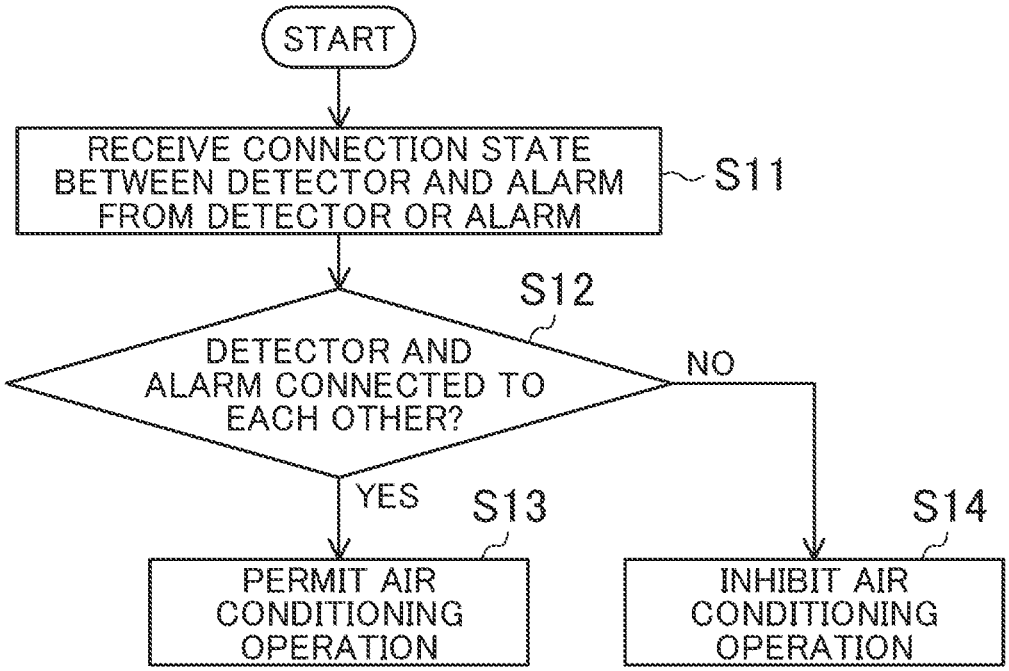
FIG. 7 is a flowchart illustrating one example of an operation control method for the air conditioning system according to the embodiment or the variation.

In this embodiment, a program stored in the air conditioning control unit (AC) (specifically, the second control device (C2) of the indoor unit (30) and/or the first control device (C1) of the outdoor unit (20)) is executed by a computer, whereby the operation control method (processing of Steps S11 to S14) illustrated in FIG. 7 is performed. However, instead of the air conditioning control unit (AC), for example, a dedicated device such as a mobile terminal, the seventh control device (C7) of the centralized monitoring device (65), or the like may be used as the operation control device for the air conditioning system (100) to perform the operation control method illustrated in FIG. 7.

Features of Embodiment

The air conditioning system (100) of this embodiment includes the air conditioning device (10), the detector (45), and the alarm (60). The air conditioning device (10) has the air conditioning control unit (AC), and conditions air in the indoor space (S). The detector (45) detects the concentration of refrigerant in the indoor space (S). The alarm (60) notifies of the refrigerant leakage in the indoor space (S). The detector (45) or the alarm (60) transmits the connection state between the detector (45) and the alarm (60) to the air conditioning control unit (AC). The air conditioning control unit (AC) inhibits operation of the air conditioning device (10) in a state in which the detector (45) and the alarm (60) are not connected to each other.

According to the air conditioning system (100) of this embodiment, operation of the air conditioning device (10) is inhibited in a state in which the detector (45) and the alarm (60) are not connected to each other. Thus, when the alarm (60) is relocated due to, e.g., a change in the layout of a room, the detector (45) is also arranged at an appropriate position together with the alarm (60) in order to start operation of the air conditioning device (10). That is, the connection between the detector (45) and the alarm (60) is set as the interlock release condition so that a failure to relocate the detector (45) upon, e.g., the change in the layout of the room can be reduced.

In the air conditioning system (100) of this embodiment, the air conditioning device (10) may have the remote (40), the alarm (60) may be built in the remote (40), and the air conditioning control unit (AC) may inhibit operation of the air conditioning device (10) in a state in which the remote (40) and the detector (45) are not wire-connected to each other. With this configuration, when the remote (40) is relocated due to, e.g., a change in the layout of the room, the detector (45) is also arranged at an appropriate position together with the remote (40) in order to start operation of the air conditioning device (10). Since the failure to relocate the remote (40) is less likely to occur, it is possible to more reliably reduce the failure to relocate the detector (45).

In the air conditioning system (100) of this embodiment, the air conditioning control unit (AC) basically inhibits operation of the air conditioning device (10) when both the detector (45) and the alarm (60) are not connected to the air conditioning device (10). However, when the detector (45) or the alarm (60) is connected to the air conditioning device (10) and the information indicating that the detector (45) and the alarm (60) are connected to each other is received from the detector (45) or the alarm (60), the air conditioning control unit (AC) may permit operation of the air conditioning device (10). In this manner, it is possible to avoid a situation where operation of the air conditioning device (10) is started in a state in which the detector (45) is not arranged at an appropriate position.

In the air conditioning system (100) of this embodiment, when the detector (45) and the alarm (60) are connected via a communication line, the alarm (60) may determine, based on the output of the detector (45), occurrence of the refrigerant leakage without the air conditioning control unit (AC). In this case, when it is determined that the refrigerant leakage has occurred, the alarm (60) may output the refrigerant leakage occurrence information to the air conditioning control unit (AC). With this configuration, based on the refrigerant leakage occurrence information, the air conditioning control unit (AC) (specifically, the second control device (C2) of the indoor unit (30)) can output a signal for operating the other countermeasure devices (50, 55), i.e., the shut-off device (50) and the ventilation device (55).

Example

Figure 8A:
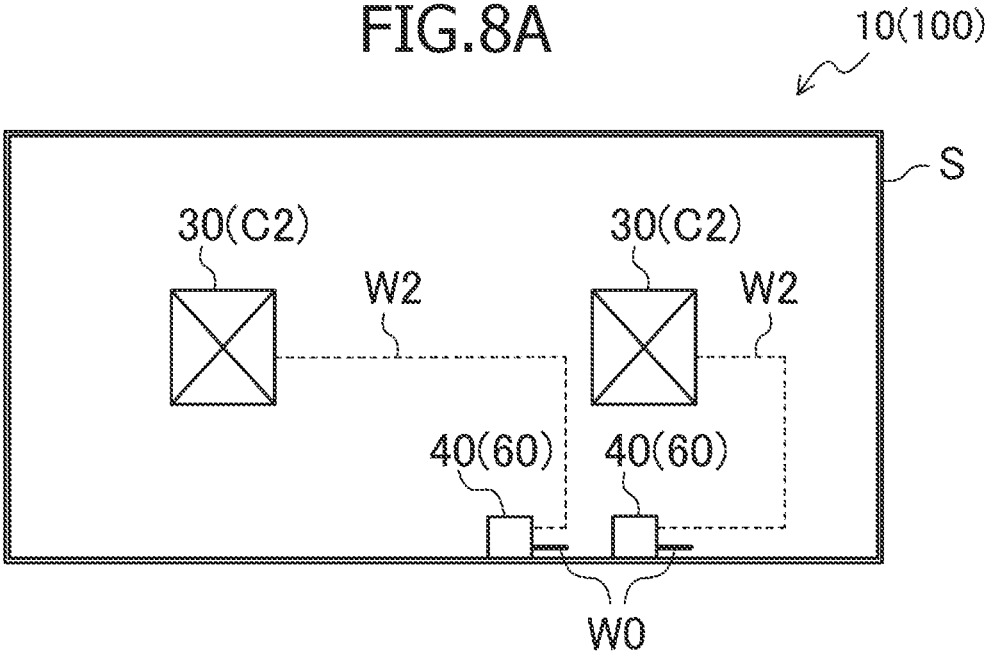
FIG. 8A is a plan view and FIG. 8B is a front view, FIGS. 8A and 8B each illustrating schematic arrangement of an air conditioning system of an example before layout change.
Figure 8B:
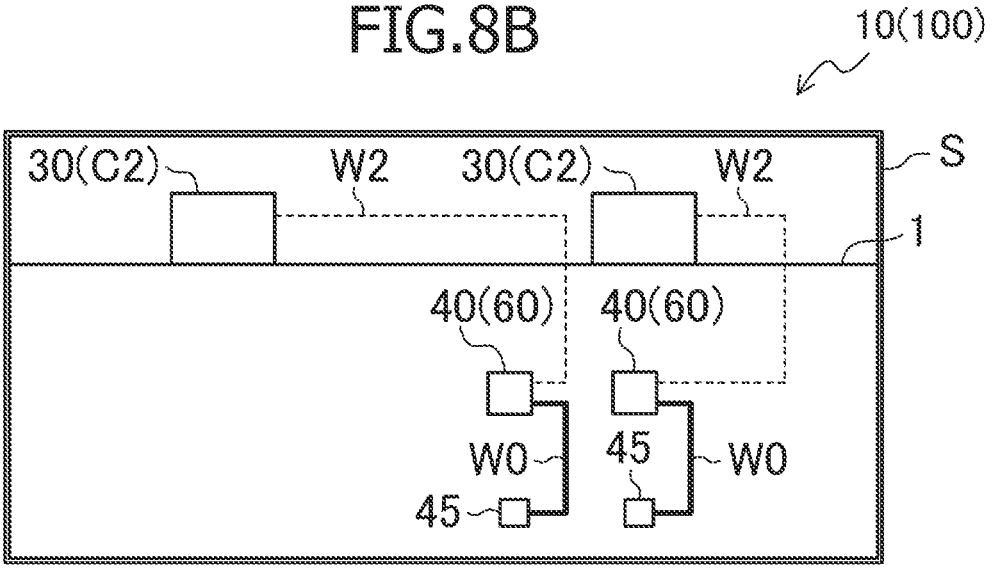
Figure 9A:
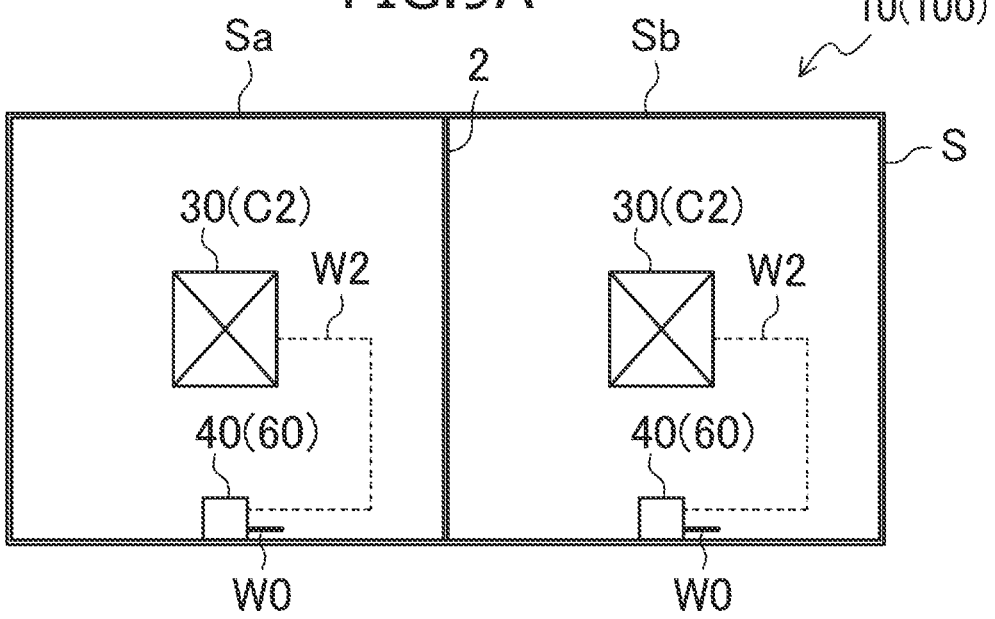
FIG. 9A is a plan view and FIG. 9B is a front view, FIGS. 9A and 9B each illustrating schematic arrangement of the air conditioning system of the example after layout change.
Figure 9B:
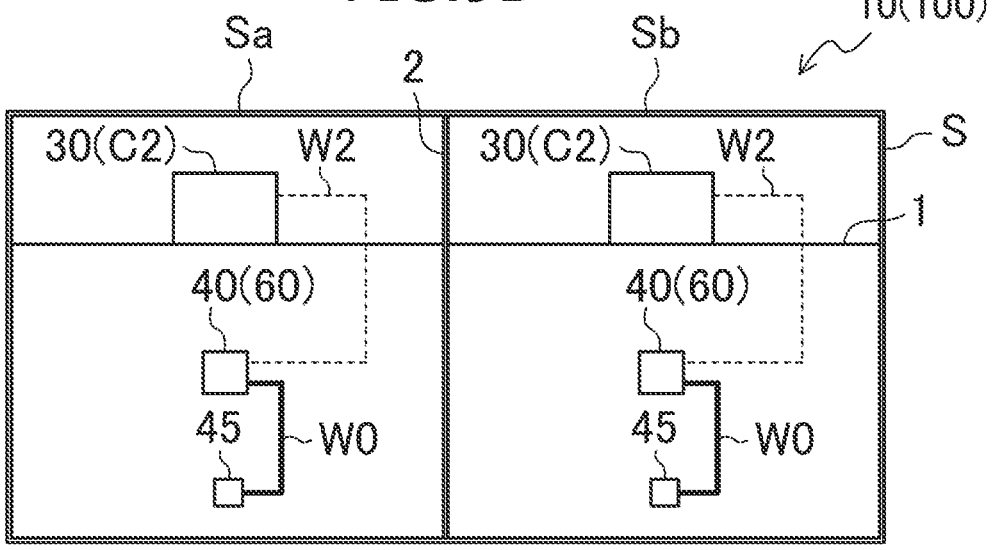

FIGS. 8A and 8B are a plan view and a front view illustrating schematic arrangement of an air conditioning system (100) of an example before layout change. FIGS. 9A and 9B are a plan view and a front view illustrating schematic arrangement of the air conditioning system (100) after the layout of the room (indoor space (S)) has been changed by a partition (2). In FIGS. 8A, 8B, 9A, and 9B, the same components as those of the embodiment (including the variations) illustrated in FIGS. 1 to 3, 5, and 6 are denoted by the same reference numerals.

As illustrated in FIGS. 8A and 8B, the air conditioning system (100) of this example includes two indoor units (30) installed on the ceiling (1) in the indoor space (S). The remote (40) is connected to the second control device (C2) of each indoor unit (30) via the second communication line (W2). The remote (40) includes the alarm (60). The detector (45) is connected to the remote (40) via the dedicated communication line (W0).

In the air conditioning system (100) of this example, the interlock release condition is that the second control device (C2) of the indoor unit (30) is connected to the remote (40) and the remote (40) is connected to the detector (45).

As illustrated in FIGS. 9A and 9B, the partition (2) is placed in the indoor space (S) to divide the indoor space (S) into a first region (Sa) and a second region (Sb). One indoor unit (30) is arranged in each of the first region (Sa) and the second region (Sb). Each of the first region (Sa) and the second region (Sb) is a space for which the safety device is necessary. Thus, the alarm (60) (remote (40)) and the detector (45) of each indoor unit (30) are relocated to appropriate positions in the first region (Sa) and the second region (Sb) so that the interlock release condition of this example is satisfied.

When the partition (2) is placed in the indoor space (S) to change the layout, the detector (45) and the alarm (60) are not necessarily relocated to appropriate positions in each region (Sa, Sb) divided by the partition (2). As one measure, the remote (40) can be reliably relocated, and therefore, if the remote (40) includes the alarm (60), a failure to relocate the alarm (60) is less likely to occur. Since the refrigerant sensor serving as the detector (45) needs to be installed within 30 cm from the floor, it is difficult to build the detector (45) in the remote (40). For this reason, if the detector (45) is connected to the remote (40) via, for example, a wire as in this example, the detector (45) is also relocated to an appropriate position together with the alarm (60) when the remote (40) is relocated due to, e.g., the layout change.

Comparative Example

Figure 10A:
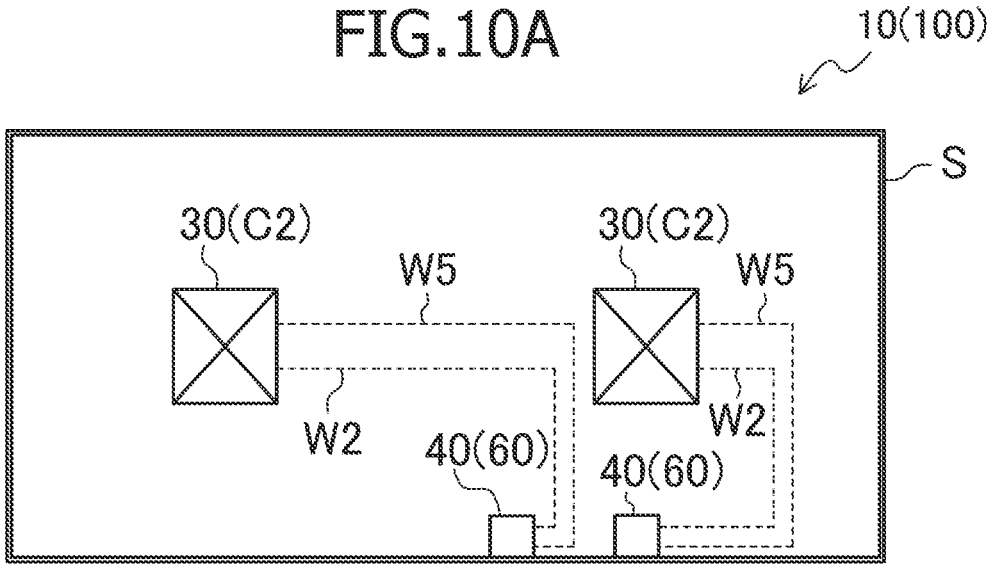
FIG. 10A is a plan view and FIG. 10B is a front view, FIGS. 10A and 10B each illustrating schematic arrangement of an air conditioning system of a comparative example before layout change.
Figure 10B:
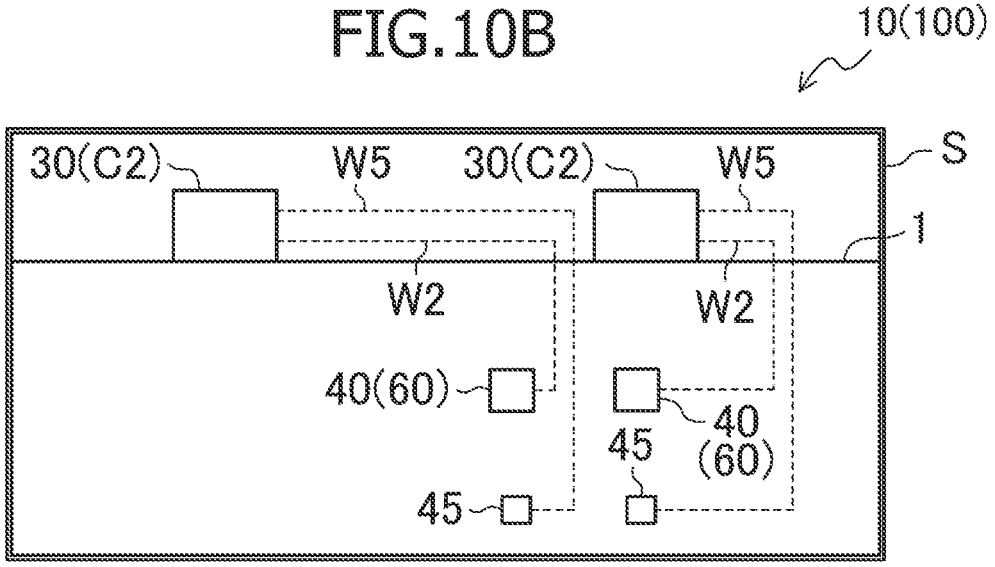
Figure 11A:
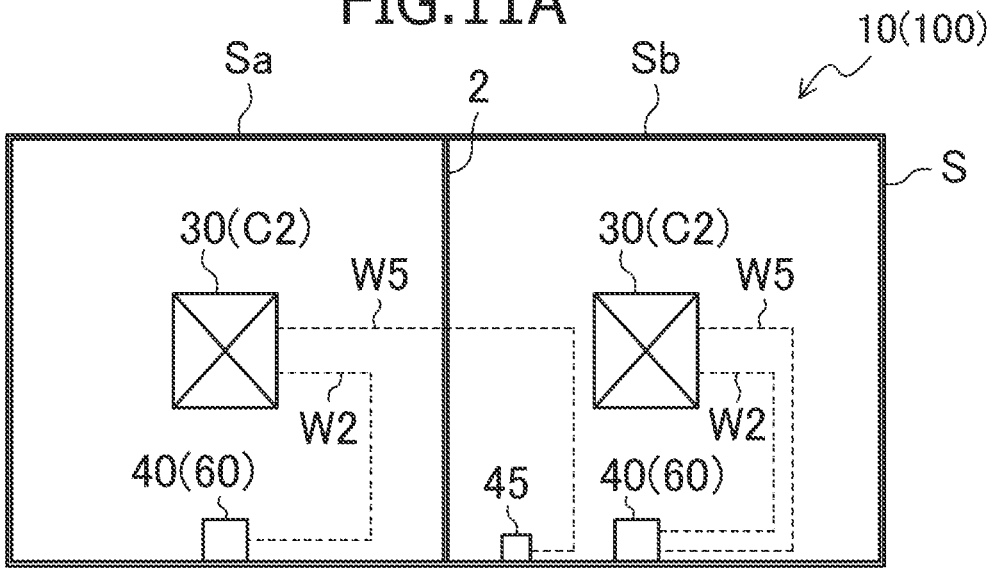
FIG. 11A is a plan view and FIG. 11B is a front view, FIGS. 11A and 11B each illustrating schematic arrangement of the air conditioning system of the comparative example after layout change.
Figure 11B:
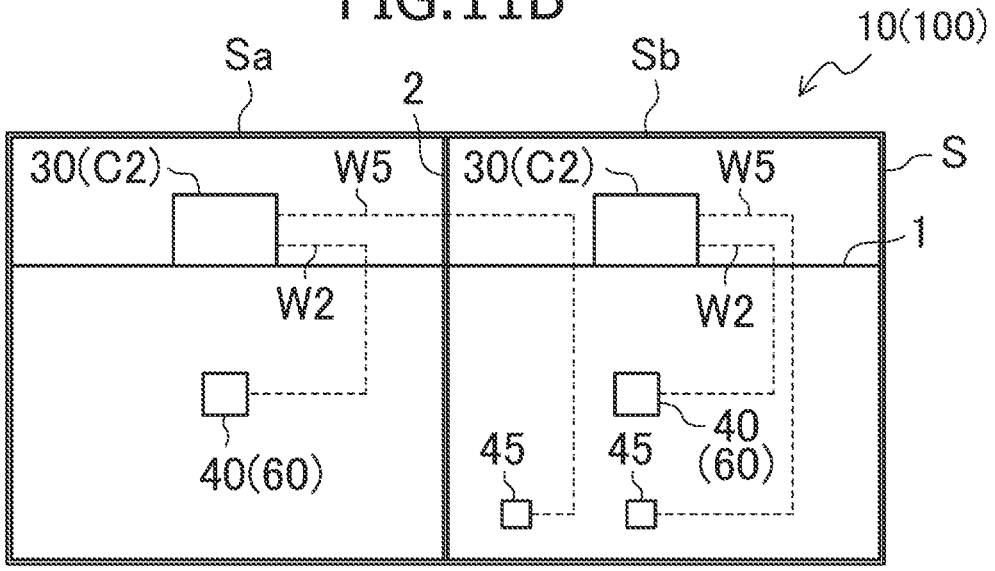

FIGS. 10A and 10B are a plan view and a front view illustrating schematic arrangement of an air conditioning system (100) of a comparative example before layout change. FIGS. 11A and 11B are a plan view and a front view illustrating schematic arrangement of the air conditioning system (100) after the layout of the room (indoor space (S)) has been changed by the partition (2). In FIGS. 10A, 10B, 11A, and 11B, the same components as those of the embodiment (including the variations) illustrated in FIGS. 1 to 3, 5, and 6 are denoted by the same reference numerals.

The air conditioning system (100) of this comparative example illustrated in FIGS. 10A and 10B is different from the example illustrated in FIGS. 8A and 8B in that the remote (40) and the detector (45) are not connected to each other and the detector (45) is connected to the second control device (C2) of each indoor unit (30) via the fifth communication line (W5).

In the air conditioning system (100) of this comparative example, the interlock release condition is that the second control device (C2) of the indoor unit (30) is connected to the remote (40) and the second control device (C2) of the indoor unit (30) is connected to the detector (45).

As illustrated in FIGS. 11A and 11B, the partition (2) is placed in the indoor space (S) to divide the indoor space (S) into the first region (Sa) and the second region (Sb). One indoor unit (30) is arranged in each of the first region (Sa) and the second region (Sb). Each of the first region (Sa) and the second region (Sb) is a space for which the safety device is necessary.

Also in this comparative example, the alarm (60) built in the remote (40) is relocated to an appropriate position in each of the first region (Sa) and the second region (Sb). However, even if the interlock release condition of this comparative example is satisfied, the detector (45) is not relocated to an appropriate position in some cases. Specifically, as illustrated in FIGS. 11A and 11B, a failure to relocate the detector (45) to the first region (Sa) has occurred.

Other Embodiments

The above-described embodiment (including variations, the same also applies hereinafter) may have the following configurations.

1) The air conditioning device (10) is not necessarily of the multi-type, but may be of a pair-type including one indoor unit (30) and one outdoor unit (20). The air conditioning device (10) may have a plurality of outdoor units (20).

2) The refrigerant circuit (11) may be filled with refrigerant other than R32. The refrigerant includes refrigerants equivalent to Class 3 (strongly flammable), Class 2 (weakly flammable), and Subclass 2L (mildly flammable) in the US standards of ASHRAE 34 Designation and Safety Classification of Refrigerant or the standards of ISO 817 Refrigerants-Designation and Safety Classification.

For example, the refrigerant is a single component refrigerant such as R1234yf, R1234ze(E), R516A, R445A, R444A, R454C, R444B, R454A, R455A, R457A, R459B, R452B, R454B, R447B, R32, R447A, R446A, or R459.

Alternatively, the refrigerant is a refrigerant mixture of two or more refrigerants selected from a group consisting of R1234yf, R1234ze(E), R516A, R445A, R444A, R454C, R444B, R454A, R455A, R457A, R459B, R452B, R454B, R447B, R32, R447A, R446A, and R459.

3) The switching mechanism (24) is not necessarily the four-way switching valve. The switching mechanism (24) may be a combination of four flow paths and on-off valves that open and close these four flow paths, or may be a combination of two three-way valves.

4) The heat-source-side expansion valve (25) and the utilization-side expansion valve (31) are not necessarily the electronic expansion valves, and may be temperature-sensitive expansion valves or rotary expansion mechanisms.

5) The indoor unit (30) is not necessarily of the ceiling mounted type, but may be of a wall mounted type or a floor mounted type.

While the embodiments have been described above, it will be understood that various changes in form and details can be made without departing from the spirit and scope of the claims. The embodiments described above may be appropriately combined or modified by replacing the elements thereof, as long as the functions of the subject matters of the present disclosure are not impaired. The expressions of "first," "second," . . . described above are used to distinguish the terms to which these expressions are given, and do not limit the number and order of the terms.

As described above, the present disclosure is useful for an air conditioning system, an operation control method therefor, and an operation control device for the air conditioning system.

The invention claimed is:

1. An air conditioning system comprising:

an air a conditioner having a controller including a processor, the air conditioner being configured to condition air in an indoor space;

a detector that detects the concentration of refrigerant in the indoor space, and an alarm that notifies of refrigerant leakage in the indoor space, the detector or the alarm transmitting information indicating whether or not the detector and the alarm are connected to each other in a wired or wireless manner, to the controller, the controller inhibiting operation of the air conditioner when the information indicates that the detector and the alarm are not connected to each other in the wired or wireless manner.

2. The air conditioner system of claim 1, wherein the air conditioner further has a remote controller, the alarm is built in the remote controller, and the controller inhibits operation of the air conditioner in a state in which the remote controller and the detector are not connected to each other in a wired or wireless manner.

3. The air conditioning system of claim 1, wherein the controller inhibits operation of the air conditioner in a state in which both the detector and the alarm are not connected to the air conditioner, and when the detector or the alarm is connected to the air conditioner and information indicating that the detector and the alarm are connected to each other in the wired or wireless manner is received from the detector or the alarm, the controller permits operation of the air conditioner.

4. The air conditioning system of claim 2, wherein the controller inhibits operation of the air conditioner in a state in which both the detector and the alarm are not connected to the air conditioner, and when the detector or the alarm is connected to the air conditioner and information indicating that the detector and the alarm are connected to each other in the wired or wireless manner is received from the detector or the alarm, the controller permits operation of the air conditioner.

5. The air conditioning system of claim 1, wherein the alarm determines occurrence of the refrigerant leakage based on an output of the detector.

6. The air conditioning system of claim 2, wherein the alarm determines occurrence of the refrigerant leakage based on an output of the detector.

7. The air conditioning system of claim 3, wherein the alarm determines occurrence of the refrigerant leakage based on an output of the detector.

8. The air conditioner system of claim 5, wherein when it is determined that the refrigerant leakage has occurred, the alarm outputs refrigerant leakage occurrence information to the controller.

9. An operation control method for an air conditioning system that includes an air conditioner that conditions air in an indoor space, a detector that detects the concentration of refrigerant in the indoor space, and an alarm that notifies of refrigerant leakage in the indoor space, the operation control method comprising:

receiving, from the detector or the alarm, a transmission of information indicating whether or not the detector and the alarm are connected to each other in a wired or wireless manner, and inhibiting operation of the air conditioner when the information indicates that the detector and the alarm are not connected to each other in the wired or wireless manner.

10. An operation control device for an air conditioning system that includes an air conditioner that conditions air in an indoor space, a detector that detects the concentration of refrigerant in the indoor space, and an alarm that notifies of refrigerant leakage in the indoor space, wherein the operation control device receives information transmitted from the detector or the alarm, the information indicating whether or not the detector and the alarm are connected to each other in a wired or wireless manner, and inhibits operation of the air conditioner when the information indicates that the detector and the alarm are not connected to each other in the wired or wireless manner.

* * * * *